US006582035B2

(12) United States Patent
Lucht et al.

(10) Patent No.: US 6,582,035 B2
(45) **Date of Patent: *Jun. 24, 2003**

(54) PRODUCT DISPLAY

(75) Inventors: Wayne Lucht, Bedford Park, IL (US); Stephen J. Franke, Chillicothe, MO (US)

(73) Assignees: Midwest Quality Gloves, Inc., Chillicothe, MO (US); Midway Displays, Inc., Bedford Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/119,697

(22) Filed: Apr. 10, 2002

(65) Prior Publication Data

US 2002/0158554 A1 Oct. 31, 2002

Related U.S. Application Data

(63) Continuation of application No. 09/713,439, filed on Nov. 15, 2000, now Pat. No. 6,428,123.

(51) Int. Cl.[7] ..... A47F 3/00

(52) U.S. Cl. ..... 312/138.1; 312/102; 312/311

(58) Field of Search ..... 312/102, 114, 312/117, 128, 138.1, 139, 139.1, 139.2, 270.1, 249.8, 249.9, 310, 311, 327; 211/126.1, 126.2, 126.5; 49/80.1, 104

(56) References Cited

U.S. PATENT DOCUMENTS

| | | | | | |
|---|---|---|---|---|---|
| 352,828 | A | * | 11/1886 | Lee | 312/139.1 |
| 640,854 | A | * | 1/1900 | Baer | 312/138.1 |
| 774,540 | A | * | 11/1904 | Stenshaug | 312/138.1 |
| 845,829 | A | * | 3/1907 | Tacke | 312/139.1 |
| 1,435,441 | A | * | 11/1922 | Zsoldos | 312/139 |
| 1,546,338 | A | * | 7/1925 | Engleman | 312/120 |
| 1,713,661 | A | * | 5/1929 | Kemball et al. | 312/117 |
| 2,761,568 | A | * | 9/1956 | Temple | 108/59 |
| 3,070,853 | A | * | 1/1963 | Brenner | 49/80.1 |
| 3,430,383 | A | * | 3/1969 | Brenner | 49/80.1 |
| 4,646,923 | A | * | 3/1987 | Winter et al. | 211/189 |
| 4,915,460 | A | * | 4/1990 | Nook et al. | 312/138.1 |
| 4,960,214 | A | * | 10/1990 | Sayers | 211/133.2 |
| 4,978,013 | A | * | 12/1990 | Hogg | 211/133.2 |
| 5,269,597 | A | * | 12/1993 | Yenglin et al. | 312/42 |
| 5,881,892 | A | * | 3/1999 | Loo | 211/133.3 |

FOREIGN PATENT DOCUMENTS

| | | | | |
|---|---|---|---|---|
| JP | 04021090 | * | 1/1992 | 312/138.1 |

* cited by examiner

*Primary Examiner*—Lanna Mai
*Assistant Examiner*—Hanh V. Tran
(74) *Attorney, Agent, or Firm*—Chase Law Firm, L.C.

(57) ABSTRACT

A product display includes a housing for sheltering and protecting a displayed product whether indoors or outdoors, a support frame mounted within the housing and adapted for displaying the product within the display and venting members for allowing air circulation. The housing has a front and rear wall each formed by a series of vertically extending, transparent doors, a roof, a floor and side walls. Each door selectively pivots between an open position and a closed position and has side lips that engage and extend over a side edge of the housing when in the closed position. At least some of the doors have a bottom lip that engages and extends over an adjacent door's front surface, and at least one of the doors engages a pivotable roof flap when in the open and closed positions, to continuously shelter the displayed products whether the doors are in an open or closed position. The support frame includes sets of cross-bars, each set having a top bar spaced apart from a bottom bar. The top bars are adapted for mounting a clip-on tray thereto and the bottom bars are for supporting the tray.

13 Claims, 6 Drawing Sheets

PRODUCT DISPLAY

This is a continuation of application Ser. No. 09/713,439 filed Nov. 15, 2000 U.S. Letters Pat. No. 6,428,123 issued Aug. 6, 2002 and entitled "Product Display", the complete disclosure of which is incorporated by reference herein.

FIELD OF THE INVENTION

This invention relates to a stand-alone, transportable product or merchandise display that shelters and protects the products and may be used in an outdoor environment. More specifically, the display is easily restocked, shelters the displayed products even during removal or replacement thereof and allows proper venting of the products.

BACKGROUND OF THE INVENTION

A variety of product displays are known. However, many are not permanent, transportable or stand-alone type displays for indoor and outdoor use. Importantly, many displays do not adequately shelter the displayed products for use outdoors. Others, while usable outdoors, are difficult and inefficient to restock and may not adequately ventilate the displayed products.

SUMMARY OF THE INVENTION

Therefore, a primary object of the subject invention is to provide a permanent, easily transportable, stand-alone, sheltered product display that accommodates rows of stacked clip trays on which to display the products, and has a front and rear series of vertically extending transparent doors corresponding to each row of clip trays, and upper and lower venting members.

Another important object of the subject invention is to provide a product display as described above wherein the products may be selectively restocked and removed from either the front or rear side of the display while the other displayed products remain sheltered.

Still another important object of the subject invention is to provide a product display that shelters the displayed products while properly ventilating them to reduce the possibility of damage, e.g., from mold and mildew.

Yet another important object of the subject invention is to provide a sheltered product display that is easily restocked.

Yet another object of the subject invention is to provide a sheltered product display that is easy to assemble, lightweight and relatively inexpensive.

These objects are attained by providing a product display comprising a housing for sheltering a displayed product from the weather, a support frame mounted within the housing and adapted for displaying the product within the display and venting members for allowing air circulation. The housing has a roof, floor, side walls and a front and rear wall presented by a series of vertically extending, transparent doors. Each door is selectively movable between an open and a closed position and has side lips that engage and extend over a side edge of the housing when closed. At least some of the doors have a bottom lip that engages and extends over an adjacent door's front surface, and at least one of the doors engages a pivotable flap member on the roof. The lips and flap member thus shelter the displayed products whether the doors are in an open or closed position. The support frame includes sets of cross-bars, each set having a top bar spaced apart from a bottom bar. The top bars are adapted for mounting a clip-on tray thereto and the bottom bars are for supporting the tray.

DETAILED DESCRIPTION

Figure 1:
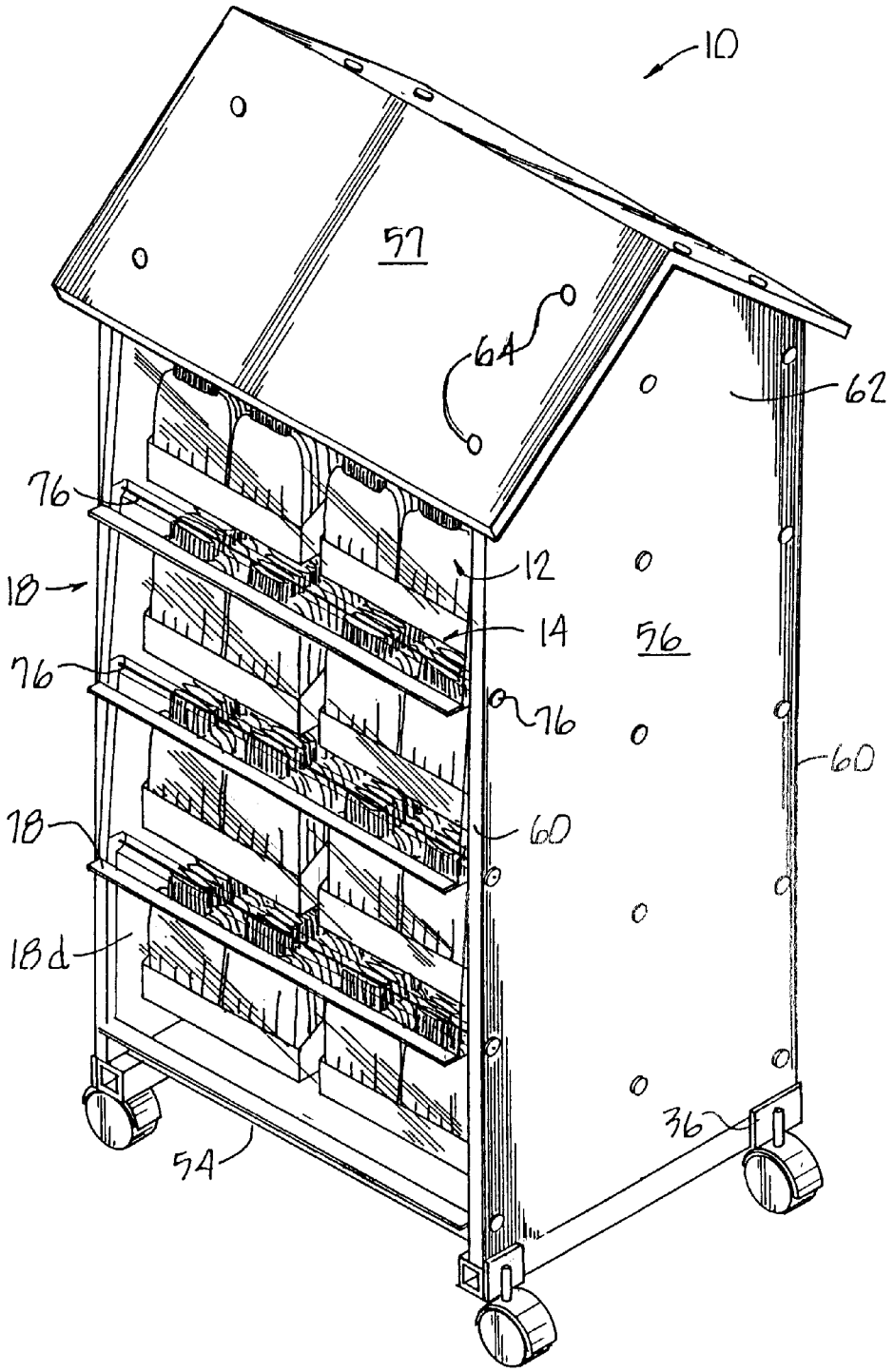
FIG. 1 is a front perspective view of a product display in accordance with the present invention, showing gloves displayed therein.
Figure 2:
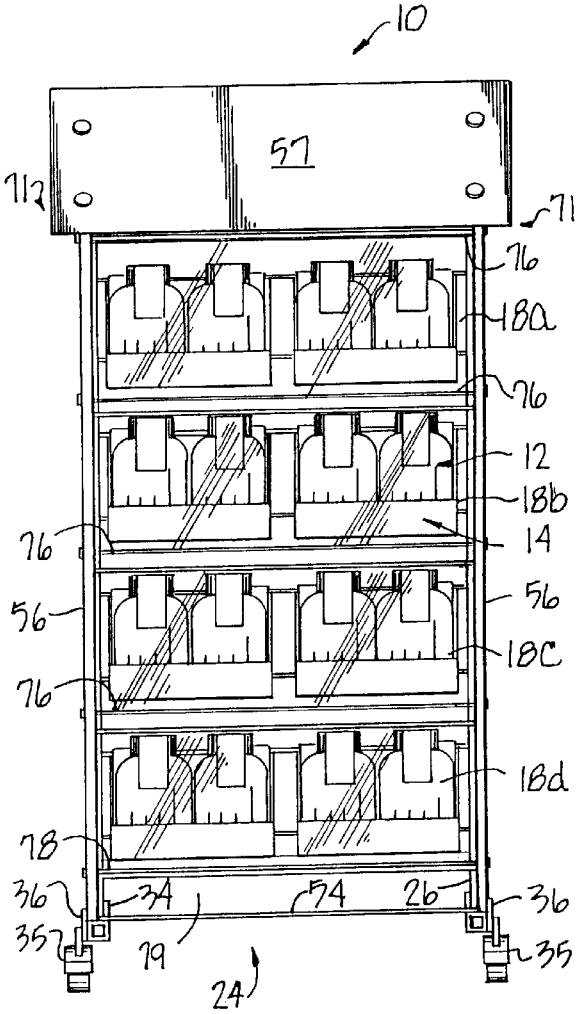
FIG. 2 is a front view of the product display of FIG. 1.
Figure 3:
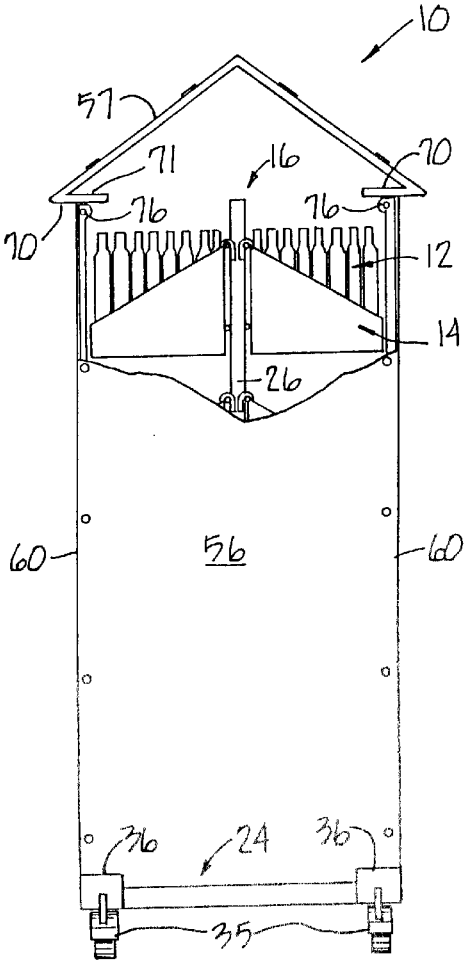
FIG. 3 is a side view of the product display of FIG. 1, partially broken away to show the roof configuration and the gloves displayed therein.

Product display 10 in accordance with the present invention is shown in FIGS. 1–3. Gloves 12 are shown displayed and will be referred to herein; however, display 10 can be used for a variety of other products. Display 10 is usable indoors or outdoors and as such, adequately shelters the gloves 12 from the elements, such as rain and snow. As shown in FIGS. 2 and 3, sets of gloves 12 are stored on display trays 14 that clip onto the display's interior frame 16. Doors 18, arranged in a vertically stacked configuration form the front and rear walls of the housing of the display 10, perform the dual function of allowing easy accessibility to gloves 12 and sheltering the gloves 12 even during removal and restocking thereof.

Figure 10:
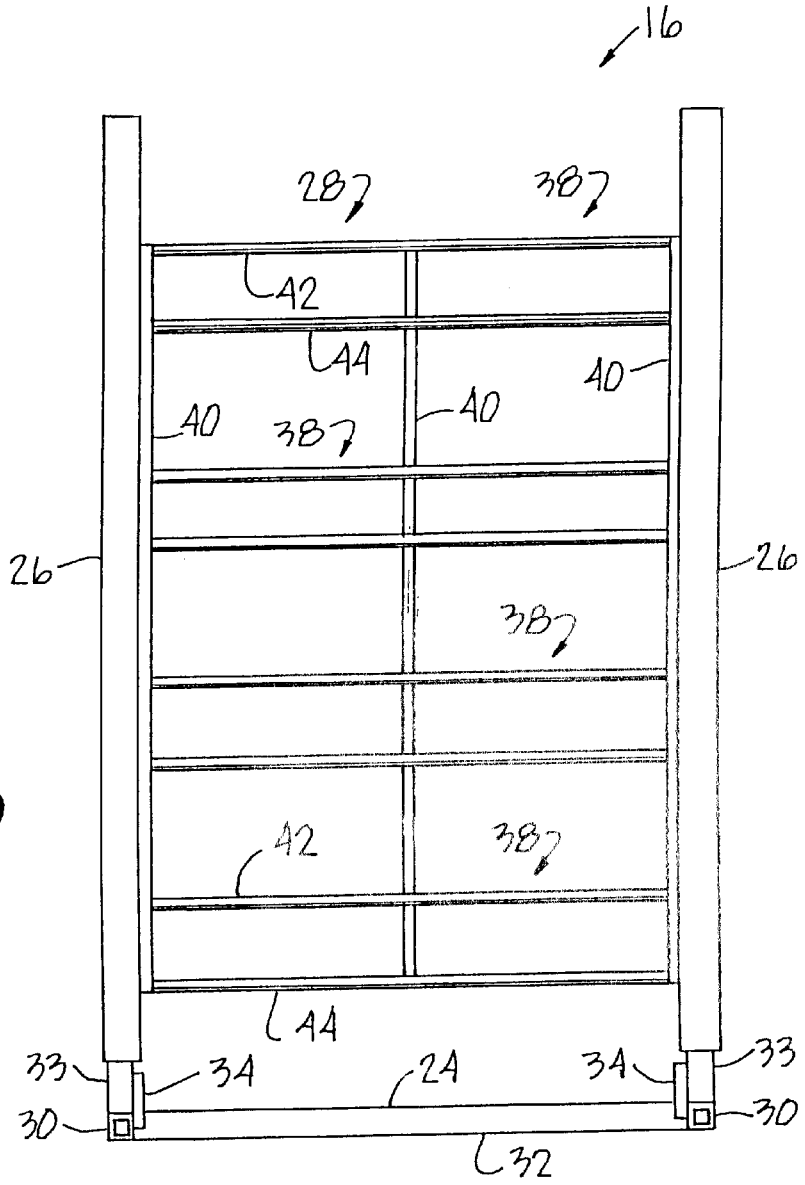
FIG. 10 is an enlarged detail front view of the support frame of the product display of FIG. 1 with the casters removed for clarity.

As best seen in FIGS. 2, 3 and 10, interior frame 16 includes a floor or base support 24, side wall supports 26 and tray support 28. Base support 24 presents an H-shape with legs 30 joined by a cross-bar 32 extending between the center-points of legs 30. A mounting projection 33 extends upwardly from the top surface of each leg 30 at the center-point thereof. Braces 34 secure projections 33 in place. Specifically, each brace 34 presents a triangle, with each brace's ends being welded to the corresponding leg 30 of floor support 24 and the mid-point of each brace 34 being welded to the interior surface of the corresponding mounting projection 33 above the floor support 24. A caster 35 is mounted to an end of each leg 30 below the base support 24. Each caster 35 has a corresponding caster tab 36 that extends upwardly therefrom, is securely mounted to the exterior surface of the corresponding leg 30 and extends beyond the top surface thereof.

A side wall support 26 is rigidly and securely mounted at one end onto each mounting projection 33 of floor support 24 in a telescoping relationship and extends vertically upwardly therefrom.

Figure 4:
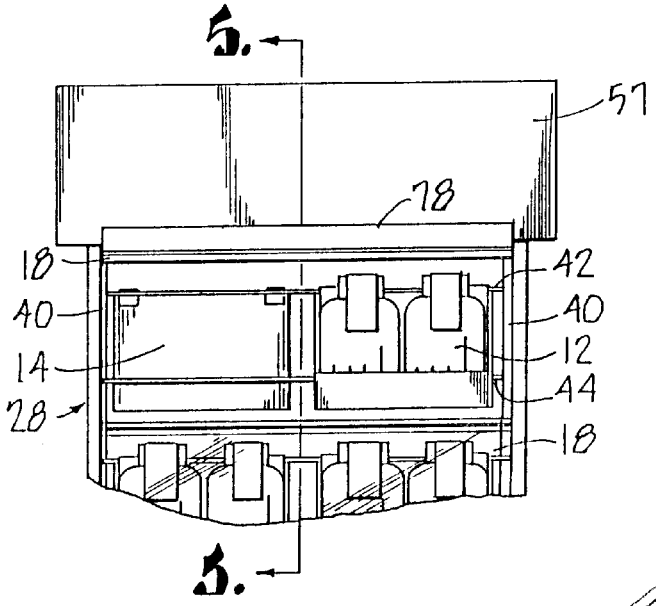
FIG. 4 is a partial front view of the product display of FIG. 1 showing the top door in its open position and with the front of the roof and one section of gloves removed for clarity.
Figure 5:
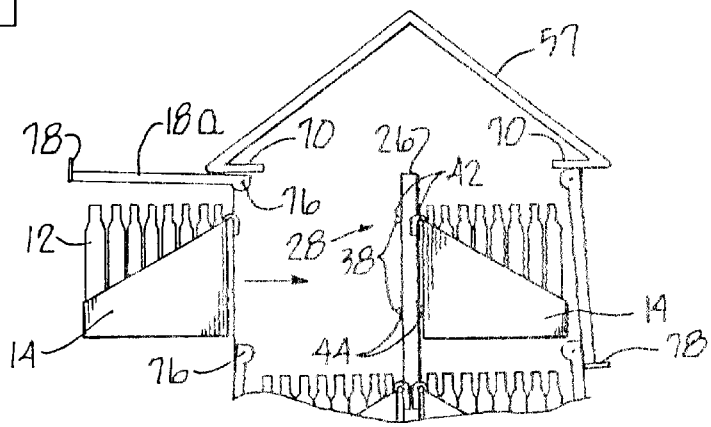
FIG. 5 is sectional view of the product display as taken along line 5—5 of FIG. 4 and showing gloves being placed therein.
Figure 6:
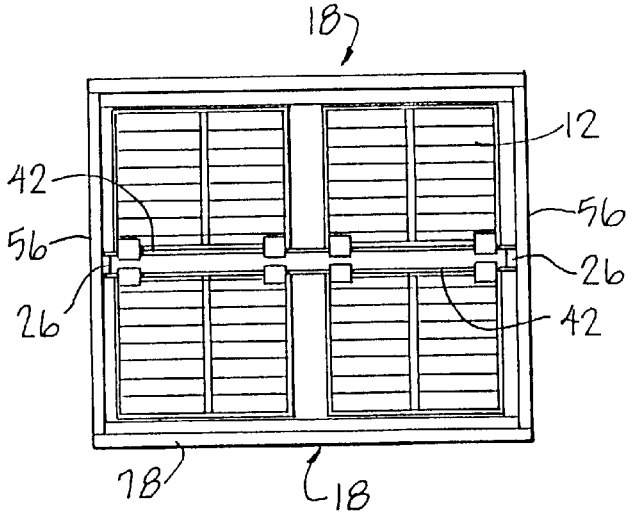
FIG. 6 is a top view of the product display of FIG. 1, with the roof removed for clarity.

As seen in FIGS. 4 and 5, tray support 28 presents opposed grid-type supports to which trays 14 are clipped. Because the grids are mirror images, only one will be discussed in detail. As seen in FIG. 10, tray support 28 includes sets or pairs of cross members 38 and vertical supports 40. Each set of cross members 38 includes a top mounting bar 42 and a bottom support bar 44 for opposed trays 14 extending horizontally between side wall supports 26. Of each set of cross members 38, the top and bottom bars 42 and 44 are spaced apart a first distance, preferably bars 42 and 44 are spaced 4¾" apart. Each set of cross members 38 is preferably spaced apart a second greater distance, approximately 8¼" apart. This spacing accommodates the easy removal of the trays 14. Interior frame 16 preferably includes four sets of cross members 38.

The vertical supports 40 extend from the uppermost top bar 42 to the lowermost bottom bar 44. A vertical support 40 is mounted adjacent each side wall support 26 and another vertical support 40 is mounted therebetween, preferably at the mid-point of cross-bars 38.

The floor 54, side walls 56 and roof 57 are lightweight and water resistant, preferably being formed of the same material. As seen in FIGS. 1 and 2, floor 54 is mounted over the floor support 24, with each corner thereof being adjacent or abutting the bottom edge of a side wall 56. Mounting tabs (not shown) are formed in the floor 54 along the side edges thereof and fit within the spaces formed between braces 34 and side wall supports 26. The floor 54 is thus held in position by the braces 34 and side walls 56.

As best seen in FIGS. 1–3, side walls 56 are identical, mirror images of one another and thus, only one will be discussed in detail. Side wall 56 is secured over the exterior surface of the side wall support 26 preferably with Christmas tree push pins which extend through the side wall 56 into receiving apertures formed in the side wall support 26. The bottom edge 60 of the side wall 56 is spaced just above or adjacent the side edge of the floor 54. The bottom corners of the side wall 56 may be kept in position by the caster tabs 36. The top portion 62 of the side wall 56 presents a peaked or triangularly shaped roof line and includes flaps (not shown) that fold inwardly from the edges thereof to secure to side walls 56 to the roof 7. The side edges 60 of the side wall 56 taper slightly outwardly and downwardly from the top portion 62. Thus, the side wall 56 is narrower in width at the top than at the bottom.

The roof 57 is secured over the side walls 56 at the flaps (not shown), preferably by plastic screws 64 and wing nuts (not shown) in a conventional manner. As seen in FIGS. 2 and 3, the front and rear edges of the roof 57 hang over or extend beyond the doors 18 and likewise, the sides of the roof 57 hang over or extend beyond the side walls 56. As seen in FIGS. 3 and 5, the roof 57 itself includes front and rear flaps 70 that fold inwardly from the front and rear edges of the roof 57. The flaps 70 thus present a vent 71 at each end thereof where the roof 57 overhangs the side walls 56.

A set or series of adjacent, vertically extending, overlapping transparent doors 18 forms the front wall and another set of doors 18 forms the rear wall of the display 10. Because each set is identical and a mirror image of the other, only one set will be discussed in detail.

Preferably and as shown, a series of four doors 18*a–d* form the front wall. Each door 18*a–d* is hingedly attached between the side walls 56 by a horizontally extending hinge rod 76 and includes a bottom, flared portion or lip 78 that overlaps the next adjacent door 18 and may act as a handle. Each bottom lip 78, as best seen in FIGS. 1 and 5, overlaps the top portion of the next adjacent door 18 in the series, except the bottom lip 78 of the lowermost door 18*d* in the series which is spaced from the floor 54 to present another venting area 79 (see FIG. 2). The top edge of the uppermost door 18*a* in the series engages the roof flap 70, as seen in FIGS. 3 and 5. This door configuration thus helps shelter and protect the gloves 12 from the weather during storage and removal thereof.

Figure 7:
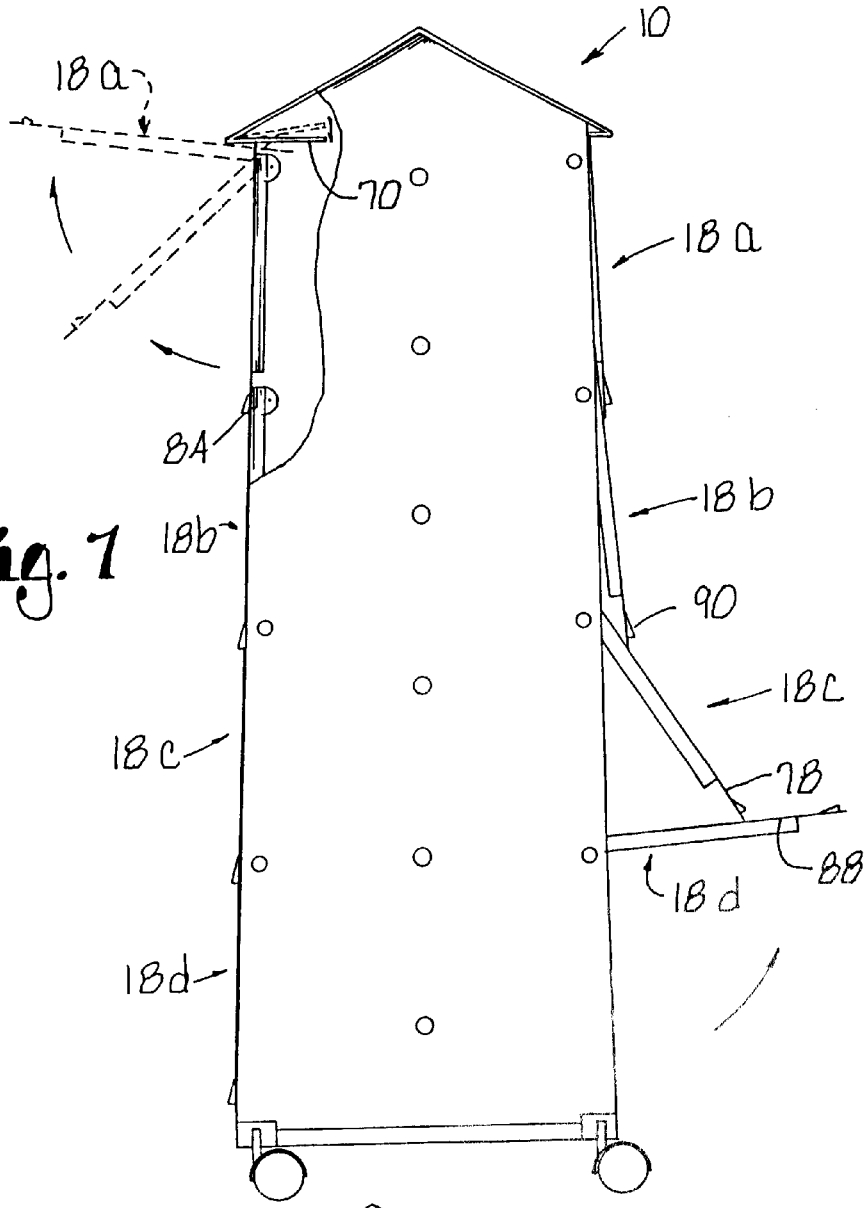
FIG. 7 is a side view of the product display in accordance with the present invention partially broken away to show the operation of the doors and showing an alternate embodiment of the doors.
Figure 8:
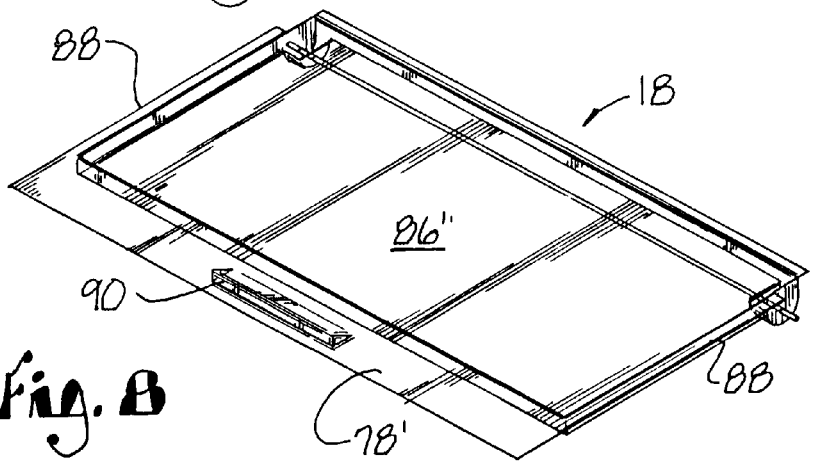
FIG. 8 is a top perspective view of a door as shown in FIG. 7.

FIGS. 7 and 8 show the preferred door configuration. As shown in FIGS. 7 and 8, each door 18 includes a top hinge portion 84, a door body 86, flared side lips 88 and flared bottom lip 78. Hinge rod 76 extends through top hinge portion 84 and is secured to side walls 56 using any conventional method. Flared side lips 88 extend outwardly and away from the sides of the door body 86 to present flanges that engage and extend beyond the side edges 66 of the product display's side walls 56 when the doors 18 are closed. Similar to the side lips 88, bottom flared lip 78 extends outwardly and downwardly from the door body 86 to present a flange that overlaps the top hinge portion of the next adjacent door 18. An outwardly extending handle 90 is formed in flared bottom lip 78. Each door 18 is one-piece and unitarily and integrally formed of transparent plastic material.

Figure 9:
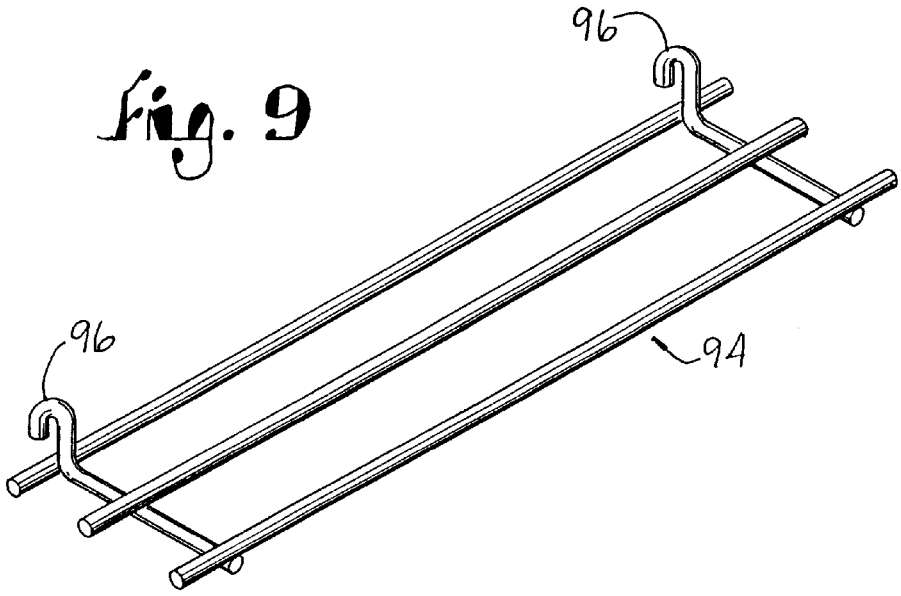
FIG. 9 is a perspective view of a shelf attachment for use with the product display in accordance with the present invention.

In operation, clip-on trays 14 full of gloves 12 are clipped onto the top cross-bars 42, as best seen in FIG. 5, to load the product display 10. Typically pre-packaged, clip-on trays 14 allow easy loading and restocking of the gloves 12 by reducing interference between the gloves 12 and are economical. Bottom cross-bars 44 act as supports to the back side of each tray 14. Alternatively, a shelf, such as shelf 94 shown in FIG. 9, may be used in place of trays 14. Shelf 94 includes hooks 96 that mount the shelf 94 to the top cross-bars 42.

As best seen in FIG. 7, as the top door 18*a* is opened and closed for insertion or removal of gloves, the top edge thereof continuously engages the adjacent roof flap 70 which pivots upwardly and downwardly to maintain a seal between the gloves 12 and the weather. As any other door 18*b, c* or *d* in either the front or rear series is opened and closed, the flared bottom lip 78 of the next higher door 18 engages the front surface of the opening or closing door.

When doors 18 are configured as in FIGS. 7 and 8, the flared side lips 88 of the door body 86 (see FIG. 7) engage the opening or closing door 18. For instance, FIG. 7 shows door 18*d* in its open position, with the flared bottom lip 78 of door 18*c* engaging the flared side lips 88 of door 18*d*. Because door 18*c* is also beginning to open, the bottom flared lip 78 of door 18*b* engages the flared side lips 88 of door 18*c*.

In this manner, the gloves 12 are continuously protected from the weather, whether during storage in the display 10 or during restocking or removal of the gloves 12. The doors form the front and rear walls to completely enclose the gloves when closed. The configuration of the doors' side and bottom lips and the roof flap, help protect the displayed gloves during the removal or restocking of gloves. In other words, the front and rear walls remain intact, except at the open door position. However, because the doors are hinged at their top edge, an open door also provides shelter to gloves being removed or restocked.

The vented areas 79 and 71 formed below the lowermost doors 18*d* and by roof flaps 70 allow air circulation without eliminating the shelter provided by the display 10. The vents 79 and 71 thus help prevent the gloves 12 from becoming damaged, e.g., due to mold or mildew.

Having thus described the invention, what is claimed as new and desired to be secured by Letters Patent is as follows:

1. A product display, comprising:

a housing for sheltering products stored and displayed therein;

a support frame mounted within said housing and including vertically spaced cross members adapted for receiving a product for display;

said housing having a wall presented by a vertically extending series of doors, each one of said doors selectively movable between an open and a closed position, each one of said doors corresponding to one of said cross members to present vertically extending product bays from which and into which a product may be selectively removed and inserted when said door thereof is in said open position;

at least one of said doors having a bottom lip that engages and overlaps an adjacent door's front surface, thereby sealing said bays when each said door is in said closed position and continuing to protect the displayed products in each said bay when said one door is selectively moved to its said open position.

2. A product display as claimed in claim 1 wherein each of said doors has a side lip that engages and overlaps a side edge of said housing when in said closed position.

3. A product display as claimed in claim 1 wherein said cross members each include an upper cross-bar spaced from a lower cross-bar, each said upper bar adapted for mounting a clip-on tray filled with display products thereto, and each said lower bar for supporting a clip-on tray.

4. A product display as claimed in claim 1 wherein said housing includes a roof that overhangs said wall, a flap member extending inwardly from an overhanging edge of said roof and pivoting about said edge, an uppermost door engaging said flap member as it moves between said closed and open positions.

5. A product display as claimed in claim 1, further comprising venting means for allowing air circulation through said display.

6. A product display as claimed in claim 5 wherein said venting means includes a first vent formed by said flap member which presents a channel into said housing where said roof overhangs said side walls and a second vent formed by a lowermost door of said series thereof spaced from a floor of said housing.

7. A product display as claimed in claim 1 wherein each of said doors include a bottom lip.

8. A product display, comprising:

a housing for sheltering displayed products and having a floor, a roof, side walls, a front wall and a rear wall;

a support frame mounted to said housing and adapted for the receiving the displayed products;

said roof overhanging said side walls and said front and rear walls;

said front and rear walls each being presented by a vertically extending series of doors, each said door selectively movable between an open and a closed position and having a side lip, and at least one of said doors having a bottom lip;

when each said door is in said closed position, said side lips engage and overlap a side edge of said housing, and said bottom lip engages and overlaps an adjacent door's front surface, to seal the displayed products within said housing;

when said one door moves between its said closed and open positions, said bottom lip engages and overlaps said adjacent door's front surface, to continue to protect the displayed products within said housing.

9. A product display as claimed in claim 8 wherein said roof includes a flap member which presents a first vent into said housing where said roof overhangs said side walls and a lowermost door and said floor present a second vent into said housing therebetween.

10. A product display as claimed in claim 8 wherein said doors include a handle member.

11. A product display as claimed in claim 8 wherein said one door is said uppermost door.

12. A product display as claimed in claim 8 wherein said series of doors includes four of said doors.

13. A product display as claimed in claim 8 wherein said roof includes a pivotal flap member, an uppermost door engaging said flap member as it moves between its said closed and open positions.

* * * * *